United States Patent [19]

Rhoads

[11] Patent Number: 4,741,298

[45] Date of Patent: May 3, 1988

[54] ROLLERIZED TIMING LIFTER

[76] Inventor: Gary E. Rhoads, 8565 Boulder Dr., La Mesa, Calif. 92041

[21] Appl. No.: 892,107

[22] Filed: Aug. 4, 1986

[51] Int. Cl.[4] ..... F01L 1/14

[52] U.S. Cl. ..... 123/90.5; 123/90.57

[58] Field of Search ..... 123/90.33, 90.35, 90.48, 123/90.5, 90.55, 90.57

[56] References Cited

U.S. PATENT DOCUMENTS

| | | | |
|---|---|---|---|
| 1,682,821 | 9/1928 | Woolson | 123/90.48 |
| 1,696,866 | 12/1928 | Seaman | 123/90.35 |
| 1,874,471 | 8/1932 | Du Bois | 123/90.48 |
| 3,299,986 | 1/1967 | Briggs et al. | 123/90.35 |
| 3,303,833 | 2/1967 | Melling | 123/90.48 |
| 3,664,312 | 5/1972 | Miller | 123/90.35 |
| 3,967,602 | 7/1976 | Brown | 123/90.35 |
| 4,173,954 | 11/1979 | Speckhart | 123/90.48 |
| 4,231,267 | 11/1980 | Van Slooten | 123/90.48 |
| 4,561,393 | 12/1985 | Kopel | 123/90.48 |

FOREIGN PATENT DOCUMENTS

| | | | |
|---|---|---|---|
| 0039575 | 11/1981 | European Pat. Off. | 123/90.48 |
| 349508 | 5/1931 | United Kingdom | 123/90.35 |

*Primary Examiner*—Charles J. Myhre
*Assistant Examiner*—David A. Okonsky

[57] ABSTRACT

A rollerized timing valve lifter for use in high performance engines. It has a press fit hydraulic mechanism utilizing an oil supply feed means from the roller body through and to the hydraulic mechanism. It has structure to maintain a self adjusting lifter to zero valve lash due to engine wear and heat expansion. It further includes a method of altering valve timing automatically through an oil restricted oil bleed passage way leading to the pressure chamber thereby allowing a leak down or delay of valve timing at low speeds. The passageway is narrow enough to become substantially inoperative at high engine speeds to thereby produce effective solid lifter action.

13 Claims, 3 Drawing Sheets

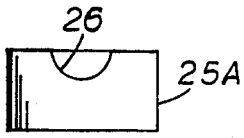
FIG. 10
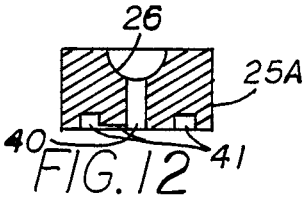
FIG. 12
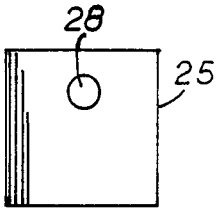
FIG. 14
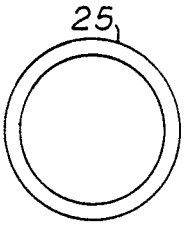
FIG. 15
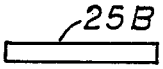
FIG. 11
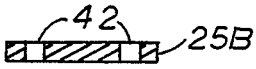
FIG. 13
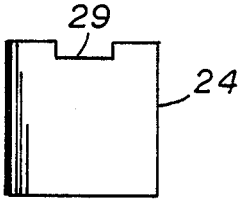
FIG. 16
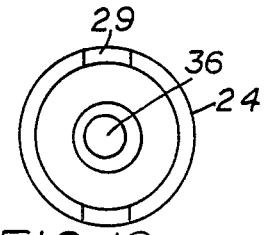
FIG. 19
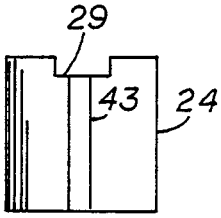
FIG. 17
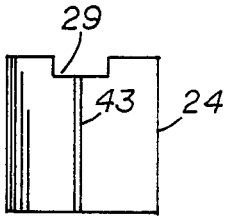
FIG. 18
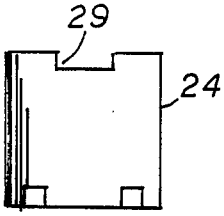
FIG. 20
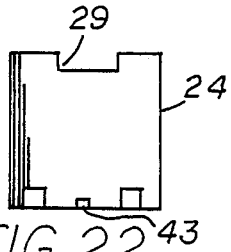
FIG. 22
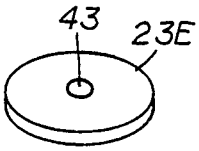
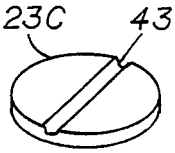
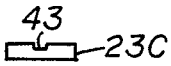
FIG. 21
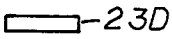
FIG. 23
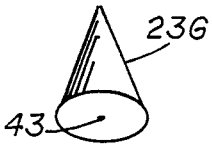
FIG. 29
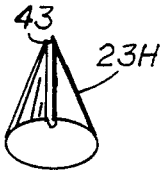
FIG. 30
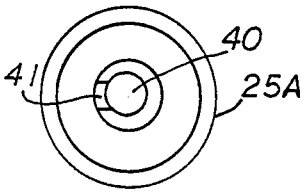
FIG. 27
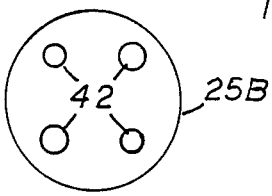
FIG. 28
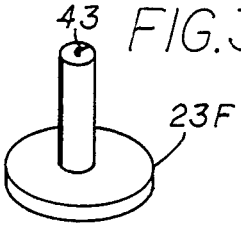
FIG. 26

ROLLERIZED TIMING LIFTER

BACKGROUND OF THE INVENTION

With conventional roller lifters, each lifter rolls over the cam surface to help eliminate friction, while the other end is engaged with a push rod seat firmly fixed to the roller body. Its job is merely to follow the cam profile, producing action to open and close the valves. This solid lifter action is inflexable and remains at an adjusted valve lash setting. As the valve train components wear with this solid type lifter, valve lash settings must be periodically reset.

With conventional types of hydraulic lifters, each valve actuating push rod seats in a plunger axially slideable in a lifter body. The lifter body rides on one lobe of the cam as it slides across the cam's surface creating friction. Oil from the engine lubrication system is introduced under pressure between the body and plunger. At increased engine speeds, the valve lifter assembly expands axially to tighten the linkage in the valve actuating train, thus maintaining a zero valve lash adjustment according to engine wear and heat expansion. Many lifters are designed to trap oil in the lifters pressure chamber during high speeds while the valves are near the floating point. Lifter pump up prevents the valve from returning back to its seat and creates engine misfire.

Hydraulic rollers are used widespread in diesel engines, their construction being a single body and a single plunger within the body and consist of a roller on the bottom end.

SUMMARY OF THE INVENTION

The valve lifter described herein is designed to provide favorable characteristics over the entire rpm range. A rollerized hydraulic timing lifter will eliminate continuous valve adjustments due to its self adjusting features, and will offer quiet operation.

However, due to high rpm's offered through the use of a roller tappet, it is further necessary to include methods for altering valve timing automatically, whereas to shorten valve overlap, duration and lift at low speeds through an oil escapement, plus during intermediate and high speeds these conditions broaden according to the engine rpm's and eliminates valve float at maximum rpm's.

Another principle object of the invention is to provide an oil escapement passageway leading from the pressure chamber of the hydraulic unit, as to delay valve timing at low speeds and automatically altering valve timing as rpm's increase for top end performance. This novel feature enables streetability on high overlap cams and all around better performance. The oil bleed escapement feature offers a tremendous horsepower increase in performance, plug an increase in economy and lower smog emissions according to the oil escapement leak down rate at low and intermediate speeds. The escapement is meticulously controlled allowing oil to escape from the lifters pressure chamber thereby shortening valve overlap, duration and lift. As the engine rpm's increase, there is simply not enough time to bleed and the pressure chamber is permitted to pump up to a fully solid condition. At high speeds the motion is so rapid that the oil can no longer escape to any degree through the restricted leak path and the lifter becomes effectively solid. This is accomplished by providing a bleed passage way to the pressure chamber which is continuously open at all operating speeds, and maybe manifested in several different configurations.

The novel features of which I consider characteristic of my invention are best set forth with particularity in the appended claims. The invention itself, however, both as to its origination and mode of operation, together with additional objects and advantages thereof, will best be understood from the following description of specific embodiments when read in connection with the accompaning drawings.

BRIEF DESCRIPTION OF THE DRAWINGS

FIG. 10 is a side elevation view of a first alternative push rod seat;

FIG. 11 is a side elevation view of an oil restrictor to be used with the push rod seat of FIG. 10;

FIG. 12 is a vertical cross sectional view of FIG. 10;

FIG. 13 is a vertical cross sectional view of FIG. 11;

FIG. 14 is a side elevation view of the oil inlet piston to be used with the push rod seat of FIG. 10;

FIG. 15 is a top plan view of FIG. 14;

FIG. 16 is a side elevation view of the internal hydraulic piston;

FIG. 17 is a side elevation view of a first alternative piston to that illustrated in FIG. 16 showing an oil escapement in the form of a flat ground portion;

FIG. 18 is a side elevation view of a second alternative piston to that illustrated in FIG. 16 showing an oil escapement in the form of a groove;

FIG. 19 is a top plan view of FIGS. 16–18, 20 and 22;

FIG. 20 is a side elevation view of a third alternative piston to that illustrated in FIG. 16 that accepts a wafer valve rather than a ball check valve;

FIG. 21 is a side elevation view of an alternative check valve;

FIG. 22 is a side elevation view of a fourth alternative piston to that illustrated in FIG. 16 having a notch in the seating area for an oil escapement;

FIG. 23 is a side elevation view of an alternative check valve to FIG. 21;

FIG. 24 is a perspective view of an alternative check valve to FIG. 21;

FIG. 25 is a perspective view of FIG. 21;

FIG. 26 is a perspective view of an alternative check valve to FIG. 21;

FIG. 27 is a bottom plan view of FIGS. 10 and 12;

FIG. 28 is a bottom plan view of FIGS. 11 and 13;

FIG. 29 is a perspective view of an alternative valve to ball check valve 23 of FIGS. 1 and 2;

FIG. 30 is a perspective view of an alternative valve to ball check valve 23 of FIGS. 1 and 2;

DETAILED DESCRIPTION OF THE PREFERRED EMBODIMENTS

Figure 1:
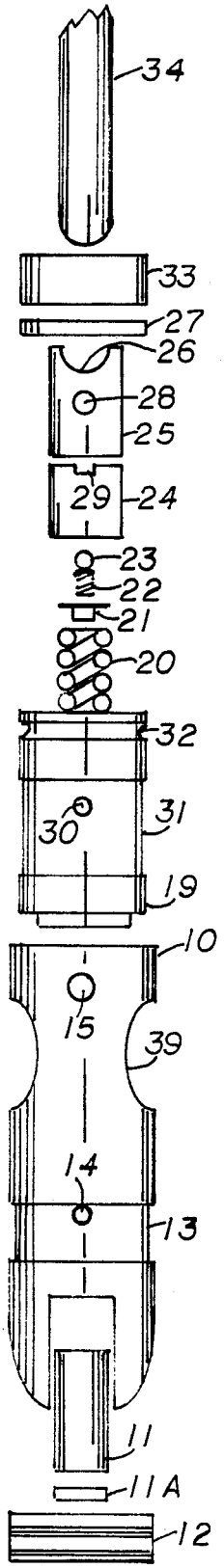
FIG. 1 is an exploded view of the roller lifter mechanism.
Figure 2:
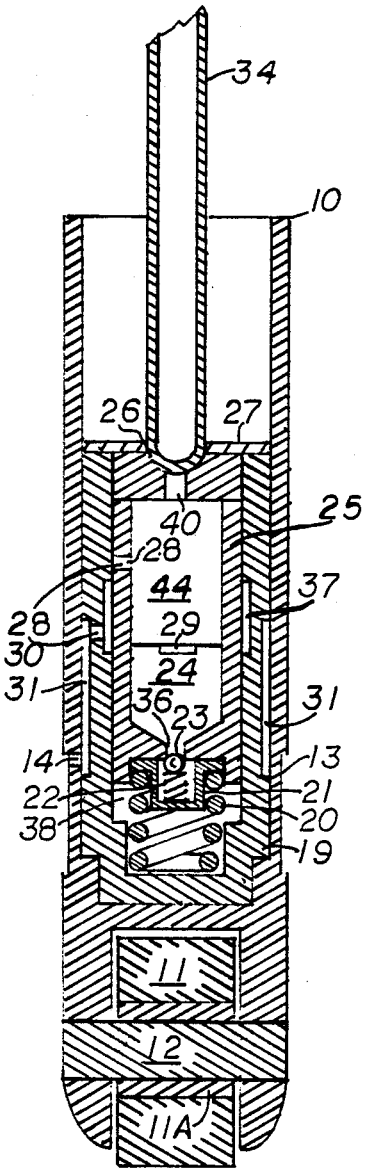
FIG. 2 is a vertical cross sectional view, taken axially along a valve lifter, showing the mechanism in the valve closed position.
Figure 3:
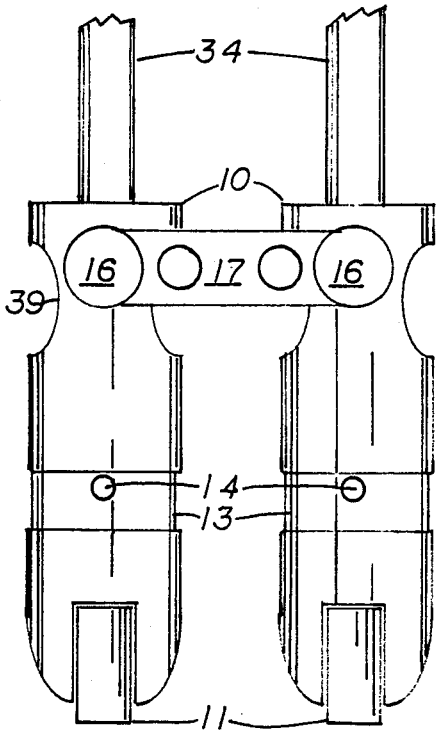
FIG. 3 is a side elevation view showing two lifters joined together.
Figure 4:
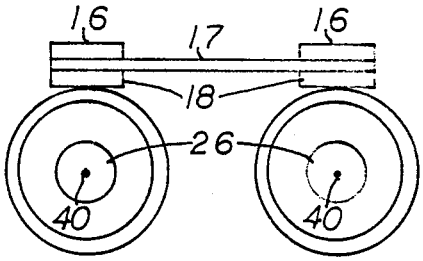
FIG. 4 is a top plan view of FIG. 3.

FIGS. 1 and 2 show the roller lifter body 10 as a single lifter made to fit in a single bore of a engine block casting, while the roller bearing 11 rolls over the face of the camshaft located in the engine. The camshaft is designed to open and close the intake and exhaust valves located in the engine head at special engineered timing degree specifications depending upon engine performance achievements. Pin 12 secures the roller bearing 11 along with needle bearing 11-A to the roller body 10. Oil channel 13 allows oil to flow through and into each lifter bore in the engine block to feed oil to each lifter while suppling oil through oil feed hole 14 during operation, while the camshaft pushes the lifter upward and thus follows the camshaft downward. A roller lifter must be stable on a fixed axis to eliminate twisting. A connecting arm 17 may attach two lifters together as shown in FIG. 3 by a rivet 16 and a washer 18 through rivet hole 15 and which is assembled through access hole 35.

Hydraulic lifter body 19 is engaged in roller lifter body 10 as a press fit. Oil enters thru oil feed hole 14 and travels around the oil channel 31 of the hydraulic body 19 and passes through oil inlet hole 30 of hydraulic body 19. Oil then passes through hole 28 from the oil channel 37, after the oil inlet piston 25 compresses against spring 20 from the rotation of the camshaft, forcing the roller bearing 11 upward. The valve spring located in the engine head (not shown) forces the pushrod 34 downward. Oil is then received in oil supply resevoir 44 from oil feed hole 28 and passes through ball check seat 36 on the upward stroke. A small amount of oil passes from oil notch 29 to lubricate the piston and hydraulic internal body 19. Ball check 23 opens against spring 22 held by a cage 21 and allows oil to flow to the pressure chamber 38 where the oil remains trapped. This allows a zero valve lash to be maintained according to engine wear and heat expansion of a normal conventional hydraulic condition. Valve timing is controlled only the camshaft profile pattern, timing points are locked in (inflexable) system. The pushrod 34 is a hollow tubular structure which seats on pushrod seat 26. Oil is fed from restricted feed hole 40 to the upper valve train components located in the cylinder head. Alternative pushrod seats seen in FIGS. 12 and 27 show a restricted oil channel 41 and a pushrod feed hole 40. A restrictor shown in FIGS. 11,13 and 28 has feed holes 42.

It may be to one's benefit to alter valve timing automatically. Opening the intake and exhaust valves later and closing them sooner results in maximum power at low rpm, plus an increase in gas mileage and a lowering of smog emissions. Opening the valves sooner and closing them later results in maximum top end horsepower. This benefit can be controlled automatically to gain maximum low end without sacrifice to the top end. This is simply done by altering or allowing an opening in the oil pressure chamber area 38 to allow oil to escape through an alternative piston 24 (shown in FIG. 17) through an oil escapement 43. When pressure is applied to the pressure chamber 38 from the rotating camshaft, it forces the lifter upward against the valve spring located in the cylinder head. The valve spring pressure forces the internal piston 24 shown on FIG. 17 downward squeezing oil from the pressure chamber 38 through oil escapement 43 allowing a lowering or a delay to take place at low rpm. As rpm's climb to a greater revolution per minute, there simply is not enough time for the oil to leak out. Therefore the timing points broaden automatically for top rpm. What was just explained is one alternative of many shown of FIGS. 5–7, 18, 22, 24–26, 29 and 30. FIG. 17 shows a flat portion 43 ground on the internal piston 24. This flat portion is an oil escapement which allows oil to escape from the pressure chamber 38. The entire inner parts of the hydraulic lifter collapse on low rpm while the roller lifter body 10 is traveling upward from the rotating camshaft. This function delays time, therefore the intake and exhaust valves located in the cylinder head,-that control the flow of gases to be burned, both incoming and outgoing are delayed during low engine rpm. This shortens the intake duration, valve lift and valve overlap. This again benefits the low end torque, mileage and lowers smog emissions a great detal. The oil bleed escapement 43 is made narrow enough to allow a change to take place in the growth of the pressure chamber area. The oil volume increases according to increased engine rpm. This causes piston 24 to rise to varing heights according to the engine's rpm's thereby changing valve timing degrees at all points of the rpm range until the engine speed becomes so rapid that piston 24 climbs to its highest point and takes up all the adjusted delayed slack or valve lash until zero lash is achieved and top end performance is broadened to the normal camshaft designed profile.

Figure 8:
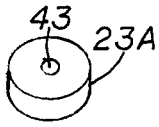
FIG. 8 is a perspective view of the press-in bleed jet of FIG. 6.
Figure 9:
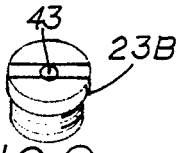
FIG. 9 is a perspective view of the screw-in bleed jet of FIG. 7.
Figure 5:
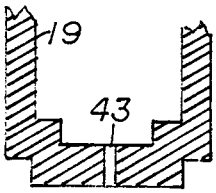
FIG. 5 is a partial vertical cross section of a first alternative oil bleed escapement.
Figure 6:
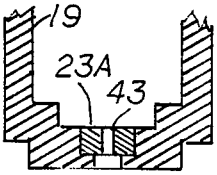
FIG. 6 is a partial vertical cross section of a second alternative oil bleed escapement showing a press-in replaceable jet.
Figure 7:
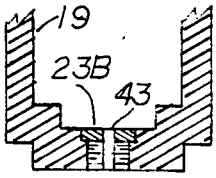
FIG. 7 is a partial vertical cross section of a third alternative oil bleed escapement showing a screw-in replaceable jet.

FIG. 5 shows an alternative oil escapement 43 having a small bore hole located in the bottom of hydrualic body 19. FIG. 6 shows another alternative oil escapement 43 having the press-fit jet 23-A shown in FIG. 8. It has a small escapement hole 43 which is available in varying sizes as a replacement jet 23-A. FIG. 7 also shows an alternative oil escapement 43 using a screw-in replacement jet 23-B such as seen in FIG. 9.

FIG. 16 is an enlarged view of piston 24. FIG. 17 is an alternative piston to that seen in FIG. 16 showing the escapement 43 as a flat grind. FIG. 18 is also an alternative piston to that seen in FIG. 16 showing a groove as an oil escapement 43. FIG. 20 shows another alternative piston to that seen in FIG. 16 having a protruded check valve seat. FIG. 21 shows a wafer check valve 23-C which engages to valve seat 36 as an alternative to piston 24 seen in FIG. 16 which uses a check ball 23 (see FIG. 1). FIG. 22 is another alternative piston to that seen in FIG. 20 showing an oil escapement in the check seat area 36 having an escapement groove 43 and it is used in combination with the flat wafer disk 23-D (see FIG. 23) and is an alternative to the ball check 23 seen in to FIG. 1. FIGS. 24–26 are alternative oil escapement valves 23-E, 23-C and 23-F that may seat against seating area 36 shown on FIG. 20. FIGS. 29 and 30 are also alternative oil escapement check valves 23-G & 23-H to the ball check 23 of FIG. 1. FIGS. 10, 11 and 14 show structure which when combined are an alternative structure to the inlet piston seen in FIG. 1 for an oil restrictor 25-A and 25-B to feed a proper amount of oil to the upper valve train.

An oil sealed bushing sleeve 33, optional to assure a proper fit to the upper hydraulic body 19 if undersize, in conjunction with roller body 10 being oversize seen in FIG. 1. The recessed groove 32 allows room for the retaining clip 27 to crimp snugly around hydraulic body 19 to hold all internal parts together. The cut away section 39 in FIG. 1 helps to eliminate unnecessary weight to the roller body 10.

Figure 31:
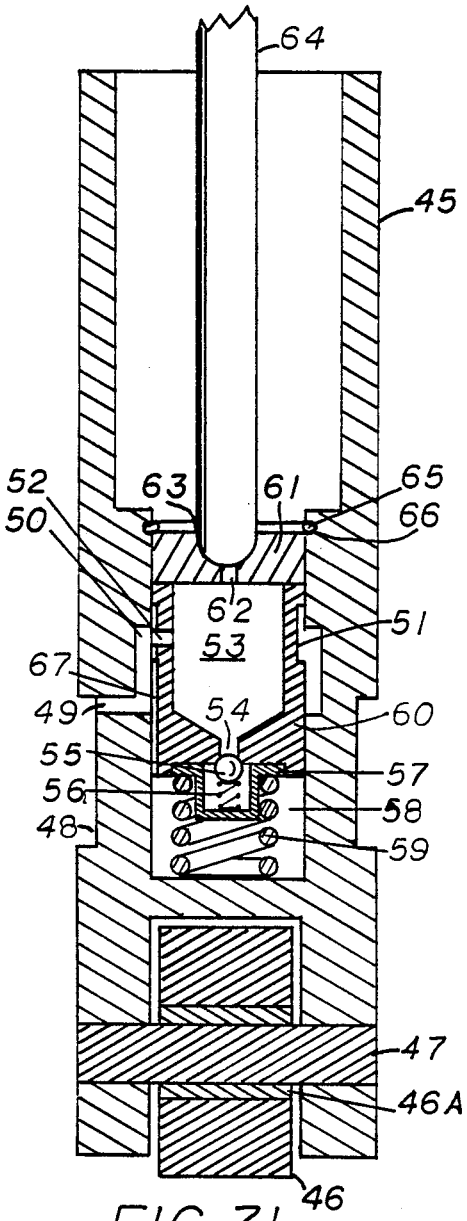
FIG. 31 is a vertical cross sectional view, taken axially along a first alternative valve lifter, showing the mechanism in the valve closed position.
Figure 32:
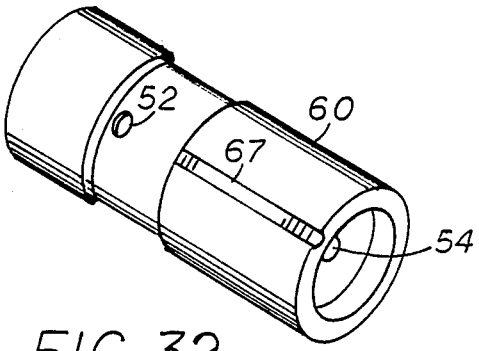
FIG. 32 is a perspective view of the piston of FIG. 31 showing the oil escapement.

FIG. 31 shows a hydraulic rollerized embodiment 45. A roller bearing 46 is supported on a pin 47 along with needle bearings 46-A. The oil channel 48 allows oil to flow to each lifter. Oil feed hole 49 allows oil to enter under pressure to the collecting channel 50. Oil is introduced through feed hole 52 to reservoir 53 and then through oil feed hole 54 when check valve 55 is open against the check valve spring 56. When the lifter body 45 starts on the down stroke oil enters the pressure chamber 58, the spring 59 pushes the plunger or piston 60 upward while the body 45 travels downward, taking on a charge of oil. Cage 57 retains check valve 55 and the check valve spring 56 together. After a new charge of oil, force from the valve spring located in the cylinder head attached to a rocker arm (not shown). Push rod 64 extends from the rocker arm to the lifters push rod seat 63 of push rod cup 61. Oil is fed through oil feed hole 62 through the push rod 64. The force from the valve spring located in the cylinder head forces the piston 60 downward, oil from the pressure chamber 58 leaks out through the oil escapement 67 and a delay of valve opening occurs until a given amount of oil due to time, escapes, and the valve then opens. Retaining clip 66 seats in a groove 65 holding the internal components together.

The alternative bleed structures described in specification also apply to FIG. 31.

The various alternative variable bleed escapements described herein are adaptable to a variety of engines and can be incorporated into many existing types of valve lifters, without requiring any changes in the engines. In fact existing lifters already in use can be modified in accordance with this disclosure. It is understood that minor variations from the form of the invention disclosed herein may be made without departure from the spirit and scope of the invention, and that the specification and drawings are to be considered as merely illustrative rather than limiting.

What is claimed is:

1. A rollerized timing lifter assembly comprising:

a first tubular roller body sleeve having a top end and a bottom end;

a roller;

means for mounting said roller on the bottom end of said first tubular roller body sleeve;

said first tubular roller body sleeve having an oil collecting channel and an oil feed port hole extending through said first tubular roller body sleeve;

a second tubular body with a top end and a closed bottom end that is placed within said first tubular roller body sleeve and engages telescopically a shoulder at near bottom of the first tubular roller body sleeve;

said second tubular body having a external collecting channel positioned around said second tubular body and a second port hole to admit oil through said second tubular body;

a hollow cylindrical plunger axially slideable in said second tubular body and enclosing a pressure chamber in the lower end of said second tubular body;

a port in said plunger communicating with said first and second mentioned ports to admit oil into the plunger;

and a valve in said plunger opening into said pressure chamber and means for receiveably capturing the bottom end of a push rod in a top end of said plunger.

2. A rollerized timing lifter comprising:

a hollow cylindrical body with a top end and a lower end;

means for mounting a roller bearing on said lower end;

said lower end having an extended leg on each side for the mounting of said roller bearing for engagement with a camshaft;

a hollow cylindrical plunger axially slidable in said body and enclosing a pressure chamber in the lower end of the body;

an external collecting channel on said body to receive oil from a pressurized source;

a port hole opening into said body;

a port hole in said plunger communicating with said first mentioned port hole to admit oil into the plunger;

a check valve in said plunger opening into said pressure chamber;

and at least one restricted oil bleed passageway to discharge oil from the pressure chamber at low and intermmediate speeds to delay valve timing;

and means for receiveably capturing the bottom end of a pushrod in a top end of said cylindrical plunger.

3. A hydraulic roller lifter assembly as recited in claim 1 or claim 2 wherein the bottom end of said pressure chamber has a bottom wall having means for bleeding hydraulic fluid out the bottom end of said hydraulic lifter.

4. A hydraulic roller lifter assembly as recited in claim 3 wherein said means for bleeding hydraulic fluid out of the bottom end of said hydraulic lifter comprises a bore of a predetermined diameter.

5. A hydraulic roller lifter assembly as recited in claim 3 wherein said means for bleeding hydraulic fluid out of the bottom end of said hydraulic lifter comprises a removeable jet that is mounted in an aperature in said bottom wall.

6. A rollerized timing lifter assembly comprising:

a tubular roller body sleeve having a top end and a bottom end;

a roller;

means for mounting said roller on the bottom end of said tubular roller body sleeve;

a hydraulic lifter having a top end and a bottom end;

said hydraulic lifter being telescopically received in said tubular roller body sleeve;

said hydraulic lifter has a tubular body having a bottom wall that closes said bottom end of said tubular roller body sleeve;

said hydraulic lifter further has a primary piston telescopically received in said tubular body spaced upwardly from a top surface of said bottom wall by a coil spring thereby forming a reservoir for hydraulic fluid;

said primary piston having a hydraulic fluid reservoir therein and having a bore hole in its bottom wall;

and check valve means for controlling the flow rate of hydraulic fluid that bleeds through said bore hole;

means for restricting how far said hydraulic lifer can be inserted towards the bottom end of said tubular roller body sleeve;

and means for receivably capturing a bottom end of a pushrod in a top end of said primary piston.

7. A hydraulic roller lifter assembly as recited in claim 6 wherein said check valve means is a wafer disk having a bore of a predetermined diameter.

8. A hydraulic roller lifter assembly as recited in claim 6 wherein said check valve means is a conical member having a bore of a predetermined diameter.

9. A hydraulic roller lifter assembly as recited in claim 6 wherein said check valve means is a conical member having a groove extending upwardly along its outer surface.

10. A hydraulic roller lifter assembly as recited in claim 6 wherein said check valve means is a wafer disk having a groove extending across its top surface.

11. A hydraulic roller lifter assembly as recited in claim 6 wherein said primary piston has means along its outer side walls for controlling the flow rate of hydraulic fluid between the inner wall of the tubular body of said hydraulic lifter and said primary piston.

12. A hydraulic roller lifter assembly as recited in claim 11 wherein said means along the outer side walls of the primary piston is a longitudinally extending groove.

13. A hydraulic roller lifter assembly as recited in claim 11 wherein said means along the outer side walls of the primary piston is a shaved flat surface.

* * * * *